US007942696B2

(12) United States Patent
Watson

(10) Patent No.: US 7,942,696 B2
(45) Date of Patent: May 17, 2011

(54) POTHEAD CONNECTORS FOR SUBMERSIBLE MOTOR HEAD AND METHODS OF ASSEMBLY THEREOF

(75) Inventor: Arthur I. Watson, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/610,842

(22) Filed: Nov. 2, 2009

(65) Prior Publication Data

US 2010/0167582 A1 Jul. 1, 2010

Related U.S. Application Data

(60) Provisional application No. 61/141,495, filed on Dec. 30, 2008.

(51) Int. Cl.
*H01R 13/40* (2006.01)

(52) U.S. Cl. ..... 439/589; 439/936

(58) Field of Classification Search ..... 439/271–279, 439/604, 586–589, 936
See application file for complete search history.

(56) References Cited

U.S. PATENT DOCUMENTS

| | | | | |
|---|---|---|---|---|
| 3,594,489 | A | 7/1971 | Katz | |
| 5,286,220 | A | 2/1994 | Watson | |
| 5,567,170 | A | 10/1996 | Kroeber | |
| 5,670,747 | A | 9/1997 | Lawer | |
| 7,325,596 | B2 * | 2/2008 | Ebner | 166/65.1 |
| 2008/0064269 | A1 | 3/2008 | Parameter | |

* cited by examiner

*Primary Examiner* — Javaid Nasri
(74) *Attorney, Agent, or Firm* — Kevin B. McGoff; Rodney Warfford

(57) ABSTRACT

A pothead connector for connecting a plurality of electrical cables to the terminal block of a submersible motor head is provided. A method of assembly of the pothead connector is also provided. The pothead connector comprises a housing that defines a plurality of passageways that extend in a longitudinal direction and are each configured to receive one of the electrical cables. Each passageway is further configured to receive a shroud that encircles the electrical cable within that one passageway. A first end of the shroud compresses a packing seal to form a liquid impermeable seal with each passageway and with the outer surface of the electrical cable. Each shroud is biased in the longitudinal direction to compress the packing seal by a plurality of spring stacks separated by a plurality of spacers. The second end of the shroud is capable configured to mate with a recess in the terminal block.

20 Claims, 6 Drawing Sheets

POTHEAD CONNECTORS FOR SUBMERSIBLE MOTOR HEAD AND METHODS OF ASSEMBLY THEREOF

CROSS-REFERENCE TO RELATED APPLICATIONS

This application claims priority to U.S. Provisional Patent Application having Ser. No. 61/141,495 filed on Dec. 30, 2008, which is incorporated by reference herein.

FIELD

The present disclosure relates to electrical cable connectors and more specifically to pothead connectors for connecting electrical cables to the terminal block of a submersible motor head, in a manner that prevents the flow of liquid into or out of the electrical cable connector and the submersible motor head. Examples provided herein are particularly useful in high-temperature applications such as up to at least 600° F.

BACKGROUND

Electric submersible pump motors are typically provided with a pothead connector for connecting a number of electrical cables to the terminal block of a submersible motor head. The pothead connector is typically field-attachable because of the impracticality of shipping and handling the motor with the long electrical cables already attached. The pothead connector and the pothole into which the pothead connector fits should include adequately insulated electrical terminals. The pothead connector and pothole should also prevent ingress of well fluid into the motor as well as prevent loss of motor oil into the wellbore. This requires seals that seal the cables to the pothead connector and seals that seal the pothead connector to the pothole. Current assemblies for doing so are limited by their materials and configurations to applications up to 550° F.

U.S. Pat. No. 7,325,596 (Ebner) discloses a pothead assembly including a tube adapted to connect to a flange member, which in turn is adapted to connect to a submersible component. The tube receives a cable that has a conductor surrounded by an insulative layer and is crimped into this insulative layer to form a fluid seal between the tube and the cable. Another fluid seal is formed between the insulative layer of the cable and the flange member by insertion of an O-ring into an O-ring groove on the flange member and around the insulative layer of the cable.

U.S. Pat. No. 5,286,220 (Watson) discloses an electrical cable connector that provides for passage of electrical conductor members through a tubular body but at the same time prevents passage of fluid through the tubular body. The connector includes semi-rigid elastomeric packing discs with flexible annular lips that seal upon the internal surface of the tubular body and the external surface of the conductor members. Compression discs urge gland discs to compress the packing discs, thus forcing the lips on the packing discs into sealing engagement with the internal surface of the tubular body and the external surface of the conductor members and sealing the interior of the tubular body against passage of fluid. Springs apply resilient compressive force to the packing discs to accommodate expansion and contraction of the elastomeric packing discs, thus maintaining the desired compressive force to effect this sealing engagement.

SUMMARY

The present inventors have identified disadvantages and drawbacks in the above-described and other prior art configurations. For example, the inventors have found that existing pothead connector configurations are not capable of withstanding temperatures above 550° F. To date, electrical cables have been provided in the art having an outer surface designed to withstand temperatures up to at least 600° F.; however, pothead connector configurations designed to withstand such temperatures and to effectively seal with the outer surface of such improved electrical cables are lacking.

The present application discloses pothead connector arrangements and methods, certain examples of which overcome disadvantages and drawbacks found in the prior art. According to an embodiment, a pothead connector includes a housing that defines a plurality of passageways extending in a longitudinal direction. Each passageway is configured to receive one of the electrical cables and is defined partly by a longitudinally extending surface and a tapered surface that extends angularly inwardly relative to the longitudinally extending surface. A plurality of shrouds is provided, each shroud having a first end disposed in one of the passageways. Each shroud is configured to encircle the electrical cable received in that one passageway. A packing seal is disposed in each of the passageways and is configured to encircle the cable received in that passageway. Each packing seal is sandwiched between the first end of the shroud and the tapered surface in that one passageway. The shroud is biased in the longitudinal direction to compress the packing seal outwardly against the tapered surface and inwardly against the electrical cable, to thereby form a liquid impermeable seal between the shroud and packing seal and a liquid impermeable seal between the packing seal and housing.

In a further example, each packing seal is in the shape of a conical frustrum and has an end surface abutting the first end of the shroud, an outer surface abutting the tapered surface of the passageway, and an inner surface abutting the electrical cable. The first end of the shroud includes an abutment surface that abuts the end surface of the packing seal to compress the seal and thereby form the noted liquid impermeable seals.

In a further example, a plurality of spring stacks is provided for providing the noted bias. Each spring stack is disposed in one of the passageways and encircles the shroud in that passageway.

In another example, a method for assembling a pothead connector for connecting a plurality of electrical cables to a terminal block of a submersible motor head is provided. The method can include (1) providing a housing that defines a plurality of passageways extending in a longitudinal direction, each passageway receiving one of the electrical cables, wherein each passageway is defined at least partly by a longitudinally extending surface and a tapered surface that extends angularly inwardly relative to the longitudinally extending surface; (2) providing a plurality of shrouds having first and second ends, wherein the first end of each shroud is disposed in one of the passageways, each shroud encircling the electrical cable received in that one passageway; (3) providing a plurality of packing seals, each packing seal disposed in one of the passageways and encircling the cable received in that one passageway, wherein each packing seal is sandwiched between the first end of the shroud and the tapered surface in that one passageway; and (4) forming a liquid impermeable seal between the shroud and the packing seal and a liquid impermeable seal between the packing seal and housing by compressing the shroud against the packing seal in the longitudinal direction. Additional assembly steps related to the above-referenced exemplary method are also provided.

BRIEF DESCRIPTION OF THE DRAWINGS

The best mode of carrying out preferred embodiments of the invention are described herein below with reference to the following drawing figures.

DETAILED DESCRIPTION OF THE DRAWINGS

In the following description, certain terms have been used for brevity, clearness, and understanding. No unnecessary limitations are to be implied therefrom beyond the requirement of prior art because such terms are used for descriptive purposes and are intended to be broadly construed. The different configurations and methods described herein may be used alone or in combination with other configurations, systems, and methods. It is to be expected that various equivalents, alternatives, and modifications are possible within the scope of the appended claims.

Figure 1:
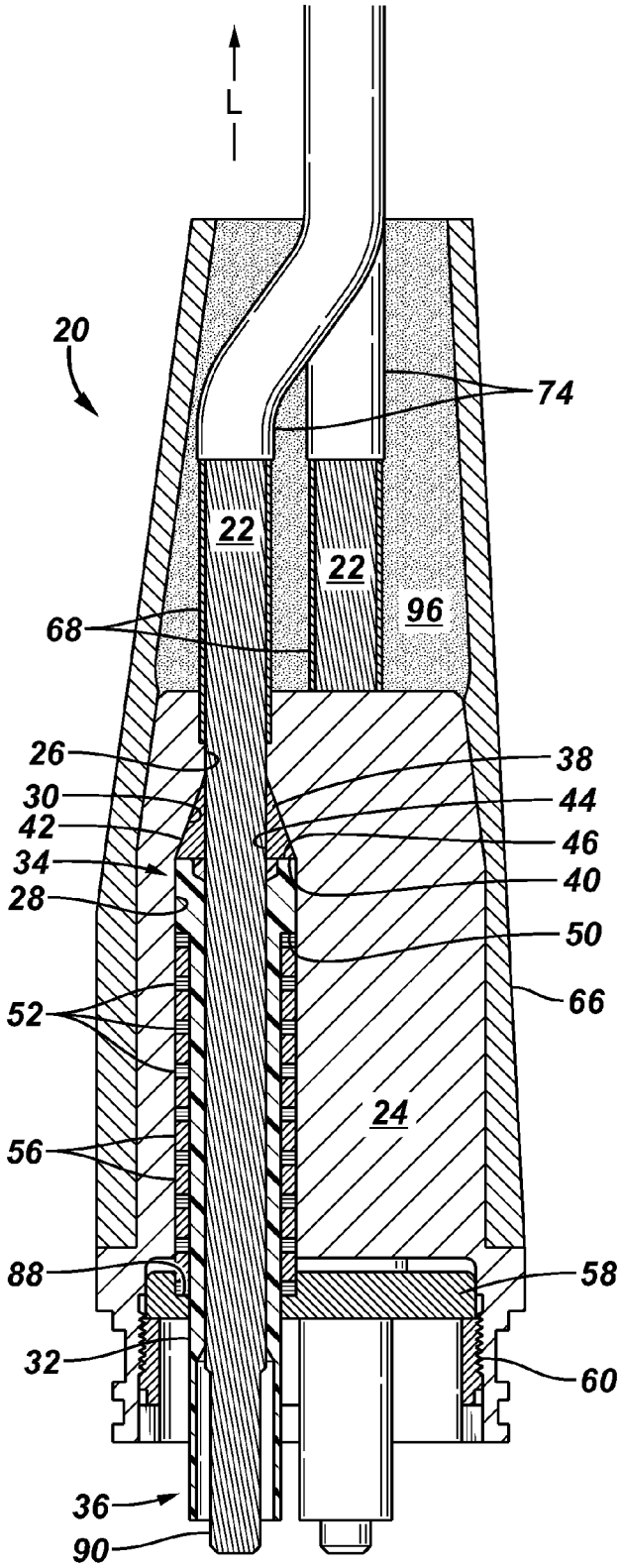
FIG. 1 depicts a pothead connector for connecting a plurality of electrical cables to a terminal block of a submersible motor head according to preferred embodiments.

FIG. 1 depicts a preferred embodiment of a pothead connector 20, connected to a plurality of electrical cables 22. The pothead connector 20 includes a housing 24 that defines a plurality of passageways, one of which is shown at 26, extending in a longitudinal direction L. Each passageway 26 is configured to receive one of the electrical cables 22. Each passageway 26 is defined partly by a longitudinally extending surface 28 and a tapered surfaced 30 that extends angularly inwardly relative to the longitudinally extending surface 28. The housing 24 is preferably made of stainless steel, but could be made of another hard metal.

A shroud 32 is disposed in each passageway 26 and encircles the electrical cable 22 received in that respective passageway 26. Each shroud has a first end 34 and a second end 36. The first end 34 of each shroud 32 is disposed in the passageway 26, but the second end 36 is not.

Each passageway 26 further contains a packing seal 38, which encircles the cable 22 received in that passageway 26. The packing seal 38 is sandwiched between the first end 34 of the shroud 32 and the tapered surface 30 in that passageway 26. The shroud 32 in each passageway 26 is biased in the longitudinal direction L to compress the packing seal 38 outwardly against the tapered surface 30 and inwardly against the electrical cable 22. This forms a liquid impermeable seal between the shroud 32 and the packing seal 38 and a liquid impermeable seal between the packing seal 38 and the housing 24.

Figure 3:
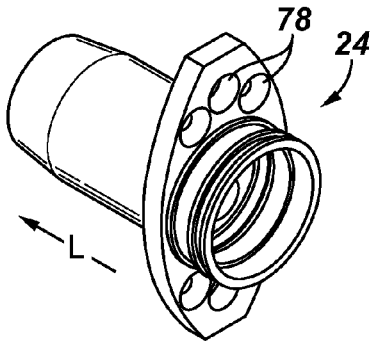
FIG. 3 depicts a preferred embodiment of a housing for the pothead connector.
Figure 4:
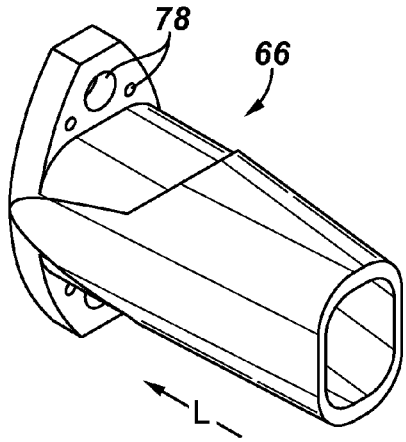
FIG. 4 depicts a preferred embodiment of an outer body configured to receive the housing and the plurality of electrical cables.

In the example shown in FIG. 1, the pothead connector 20 is composed of two main parts, the housing 24 and the outer body 66. Both the housing 24 and the outer body 66 are preferably made of stainless steel, but could be made of any other hard metal. A detailed view of the housing 24 is shown in FIG. 3. A detailed view of the outer body 66 is shown in FIG. 4. The housing 24 and the outer body 66 can be connected by threading screws (not shown) through screw holes 78.

Figure 5A:
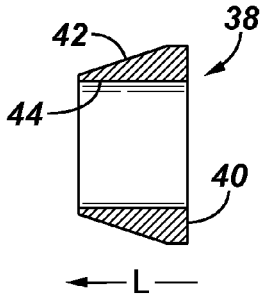
FIG. 5*a* depicts one view of a preferred embodiment of a packing seal located in one of the passageways and for encircling the cable received in that one passageway.
Figure 5B:
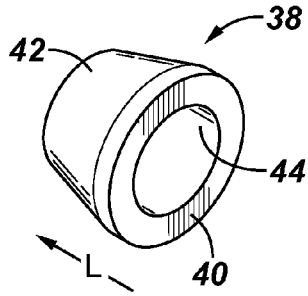
FIG. 5*b* depicts another view of the packing seal embodiment of FIG. 5*a*.
Figure 5C:
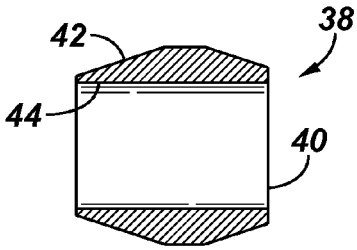
FIG. 5*c* depicts a preferred embodiment of a packing seal.
Figure 5D:
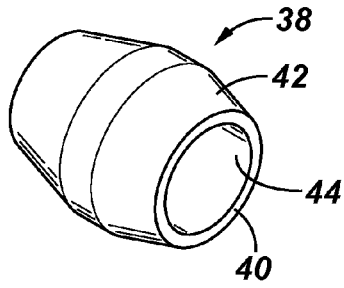
FIG. 5*d* depicts another view of the packing seal embodiment of FIG. 5*c*.

FIG. 5*a* depicts a close-up of one embodiment of the packing seal 38. FIG. 5*b* depicts another view of this embodiment. Referring to both FIGS. 5*a* and 5*b*, the packing seal 38 is a conical frustrum that has an end surface 40, an outer surface 42, and an inner surface 44. In another embodiment, the packing seal 38 could for example have the shape of a pair of opposed conical frustrums separated by a cylindrical section, as shown in FIGS. 5*c* and 5*d*. Preferably, the packing seal 38 is made of perfluoroelastomer, but it could also be made of a different polymer, graphite, or fiber. Perfluoroelastomer packing seal 38 may have a hardness as low as 60 durometer. Filler material used with the elastomer may consist primarily of non-black fillers to retain dialectric properties of the packing seal 38. This embodiment of the packing seal 38 is able to maintain a higher sealing force and a more sustained sealing force than that of O-rings used in the prior art. In order to conform to the outer surface of the improved electrical cables 22, the packing seal 38 may also be treated to enhance its sealing capabilities. For example, the packing seal 38 may be coated or over-molded with a softer compound that enables its inner surface 44 to better conform to the outer surface of the newer electrical cable 22. However, the inner core of the packing seal 38 preferably still should be able to resist extrusion. In another embodiment, the packing seal 38 may be treated with a solvent to soften its inner surface 44 to enable it to seal onto the newer electrical cables. In another embodiment, the packing seal 38 may be softened by heating the pothead above 200 degrees Fahrenheit after assembly to allow the inner surface 44 of the packing seal 38 to conform to outer surface of the electrical cable 22.

Figure 6:
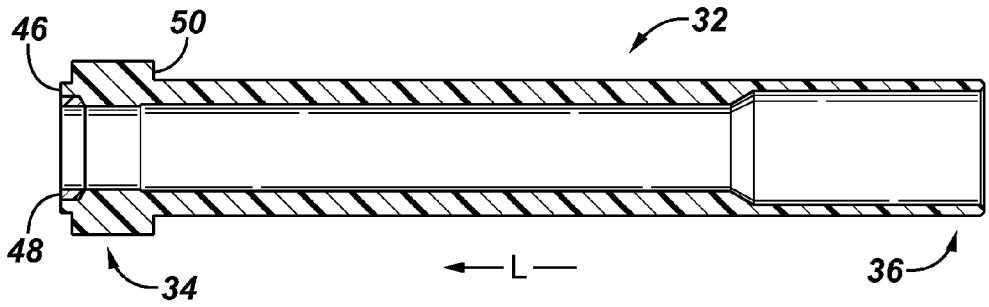
FIG. 6 depicts a preferred embodiment of a shroud for encircling the electrical cable.

FIG. 6 depicts one example of the shroud 32. The shroud 32 has a first end 34 and a second end 36. The shroud 32 also has an abutment surface 46 and an outwardly extending shoulder surface 50. An anti-extrusion ring 48 is provided at the first end 34 of the shroud 32, and will be described further herein below. The shroud 32 is preferably made of polyimide in order to withstand temperatures of up to 600 degrees Fahrenheit. However, it could alternately be made of another insulating material such as PEEK, another polymer, elastomer, or ceramic. In another embodiment, such as when the packing seal 38 has the shape of a pair of opposed conical frustrums separated by a cylindrical section as shown in FIG. 5*c*, the shroud 32 could have a shape in which its first end 34 has outwardly tapered ends extending from its first end 34 that are capable of engagement with the inwardly tapered surface of one side of the packing seal 38.

Figure 7:
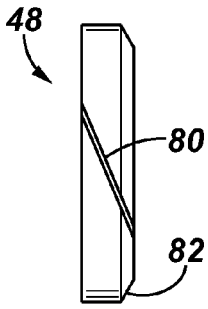
FIG. 7 depicts one view of a preferred embodiment of an anti-extrusion ring located between the shroud and the packing seal.

FIG. 7 shows one embodiment of the anti-extrusion ring 48. The anti-extrusion ring 48 has a scarf cut 80 and an angularly inwardly extending surface 82. Preferably, this angularly inwardly extending surface 82 is less than 90 degrees from the longitudinal axis L so that the anti-extrusion ring 48 can better seal around the electrical cable 22. The scarf cut 80 allows for expansion of the anti-extrusion ring 48 when the electrical cable 22 expands due to higher temperatures. The angled surface 82 allows for contraction of the electrical cable 22 at lower temperatures. Preferably, the anti-extrusion ring 48 is polyimide; however, it could also be metal, elastomer, or fiber.

Figure 8:
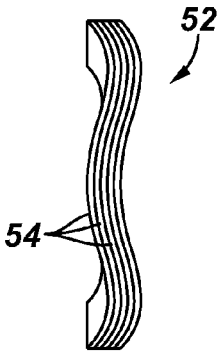
FIG. 8 depicts a preferred embodiment of a spring stack for encircling the shroud.
Figure 9:
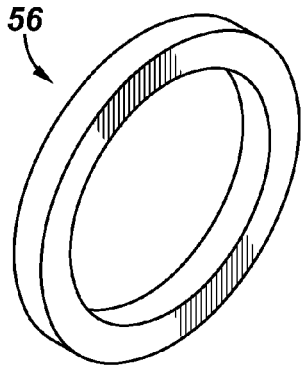
FIG. 9 depicts a preferred embodiment of a spacer for encircling the shroud.

In the embodiment shown in FIG. 1, each passageway 26 also contains a plurality of spring stacks 52 and a plurality of spacers 56. One embodiment of a spring stack is shown in FIG. 8. Preferably, the spring stacks 52 are made of multiple wave springs 54 nested together, as shown in FIG. 8, to multiply the spring constant. However, the spring stacks 52 could also be composed of Belleville springs. The spring stacks 52 are preferably made of Hastelloy or some other hard metal. The plurality of spring stacks 52 can be separated by a plurality of spacers 56. In the example shown, each spring stack 52 is separated from another spring stack 52 in the plurality of spring stacks by at least one spacer 56. One embodiment of a spacer is shown in FIG. 9. The spacers 56 are preferably made of steel, but could also be made of any other metal that is harder than the material of which the spring stacks 52 are made. If Belleville springs are used, the deflection of these springs can be increased by inverting alternating stacks of nested springs 52, instead of by using spacers 56.

Figure 10A:
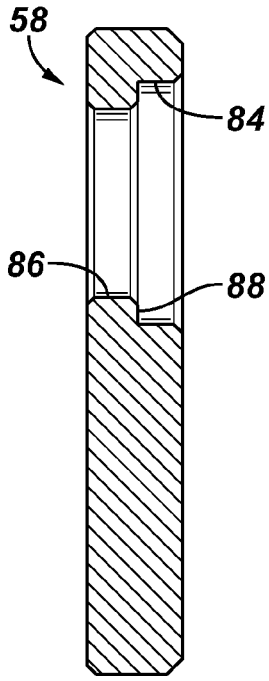
FIG. 10*a* depicts one view of a preferred embodiment of a compression disc that is movable by a compression nut.
Figure 10B:
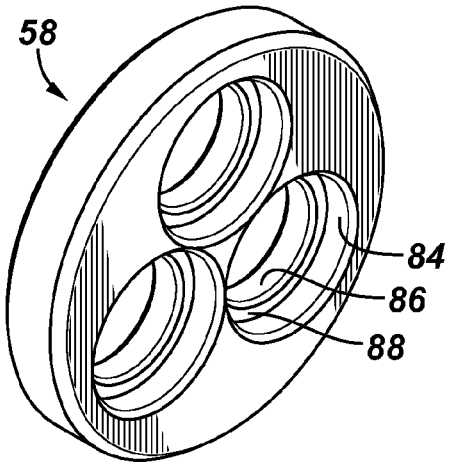
FIG. 10*b* depicts another view of a preferred embodiment of the compression disc.
Figure 11:
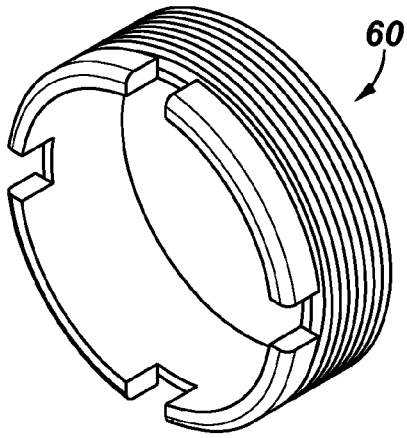
FIG. 11 depicts a preferred embodiment of a compression nut for moving the compression disc.

The pothead connector 20 in FIG. 1 also has a compression disk 58 and a compression nut 60. A detailed view of one example of the compression disk 58 is shown in FIG. 10*a*. FIG. 10*b* shows the compression disk 58 in an alternate view. The compression disk has one bore 84 for each electrical cable 22. The example in FIG. 10*a* shows only one bore 84 for the passage of one electrical cable 22. However, as shown in FIG. 10*b*, there could be two, three, or more bores 84 to coincide with the number of electrical cables 22. The compression disk 58 in FIG. 10*a* further includes an inner annular shoulder 88 created by the difference in diameter between the bore 84 and a counter-bore 86. The compression disk 58 is preferably made of stainless steel, but could be made of any other hard metal. FIG. 11 depicts one example of the compression nut 60 that moves the compression disk 58. Preferably, the compression nut 60 is made of bronze, but could be made of any other metal as well.

Referring now to FIGS. 1, 5*a*, 5*b*, and 6, the functionality of the packing seal 38 will now be described. The end surface 40 of the packing seal 38 abuts the first end 34 of the shroud 32. The outer surface 42 of the packing seal 38 abuts the tapered surface 30 of the passageway 26. Finally, the inner surface 44 of the packing seal 38 abuts the electrical cable 22. Liquid impermeable seals are thereby formed between the first end 34 of the shroud 32 and the end surface 40 of the packing seal 38, between the outer surface 42 of the packing seal 38 and the tapered surface 30 of passageway 26, and between the inner surface 44 of the packing seal 38 and the electrical cable 22. As the shroud 32 is biased in the longitudinal direction L, it compresses the packing seal 38 in the longitudinal direction L, causing the packing seal 38 to compress outwardly against the tapered surface 30 of the passageway 26 and inwardly against the electrical cable 22, thus forming the above-mentioned liquid impermeable seals. Because each cable 22 is provided with an individual packing seal 38, much less elastomer (in this example polyimide) than in previous designs is needed to adequately seal the electrical cables 22 against liquid contact. This in turn reduces the amount of spring compensation required to maintain the compression to seal the packing seal 38 against the electrical cable 22 and the tapered surface 30 of the passageway 26. Finally, an individual packing seal 38 for each electrical cable 22 reduces the effect that tolerance accumulation on the other electrical cables 22 has on the compression maintained on the individual packing seal 38. This in effect means that each electrical cable 22 is sealed against contact with liquid by its own packing seal 38 that is not affected by any of the other seals 38 on the other electrical cables 22.

Referring now to FIGS. 1 and 6, the functionality of the shroud 32 will be further described. The abutment surface 46 of the shroud 32 abuts the end surface 40 of the packing seal 38 such that the two surfaces 46 and 40 are face-to-face. When the shroud 32 is biased in the longitudinal direction L, a compression force is transferred to the packing seal 38 by the contact between the two surfaces 46 and 40. In the example shown, the shroud 32 and packing seal 38 are provided with an anti-extrusion ring 48, which is sandwiched between the abutment surface 46 of the shroud 32 and the end surface 40 of the packing seal 38. The anti-extrusion ring 48 operates to prevent extrusion of the packing seal 38 material between the electrical cable 22 and the shroud 32. The outwardly extending shoulder surface 50 of the shroud 32 receives the compressive force from the spring stacks 52 and the spacers 54, as will be described further herein below. Finally, the second end 36 of the shroud 32 is configured to mate with a recess 76 in a terminal block 62 of a submersible motor head 64, as shown in FIG. 2.

Referring now to FIGS. 1, 8, and 9, the functionality of the spring stacks 52 and the spacers 56 will be further described. The spring stacks 52 and the spacers 56 encircle the shroud 32 in each passageway 26 and operate to bias the shrouds 32 in the longitudinal direction L against the packing seals 38. This occurs in the following manner. The compression nut 60 compresses the compression disk 58. Contact with the inner shoulder 88 of the compression disc 58 applies compression in the longitudinal direction L on the spring stacks 52 and spacers 56. This compression is then transferred to the shoulder surface 50 of the shroud 32. This then causes the abutment surface 46 of the shroud 32 to compress the packing seal 38, as described above.

Figure 2:
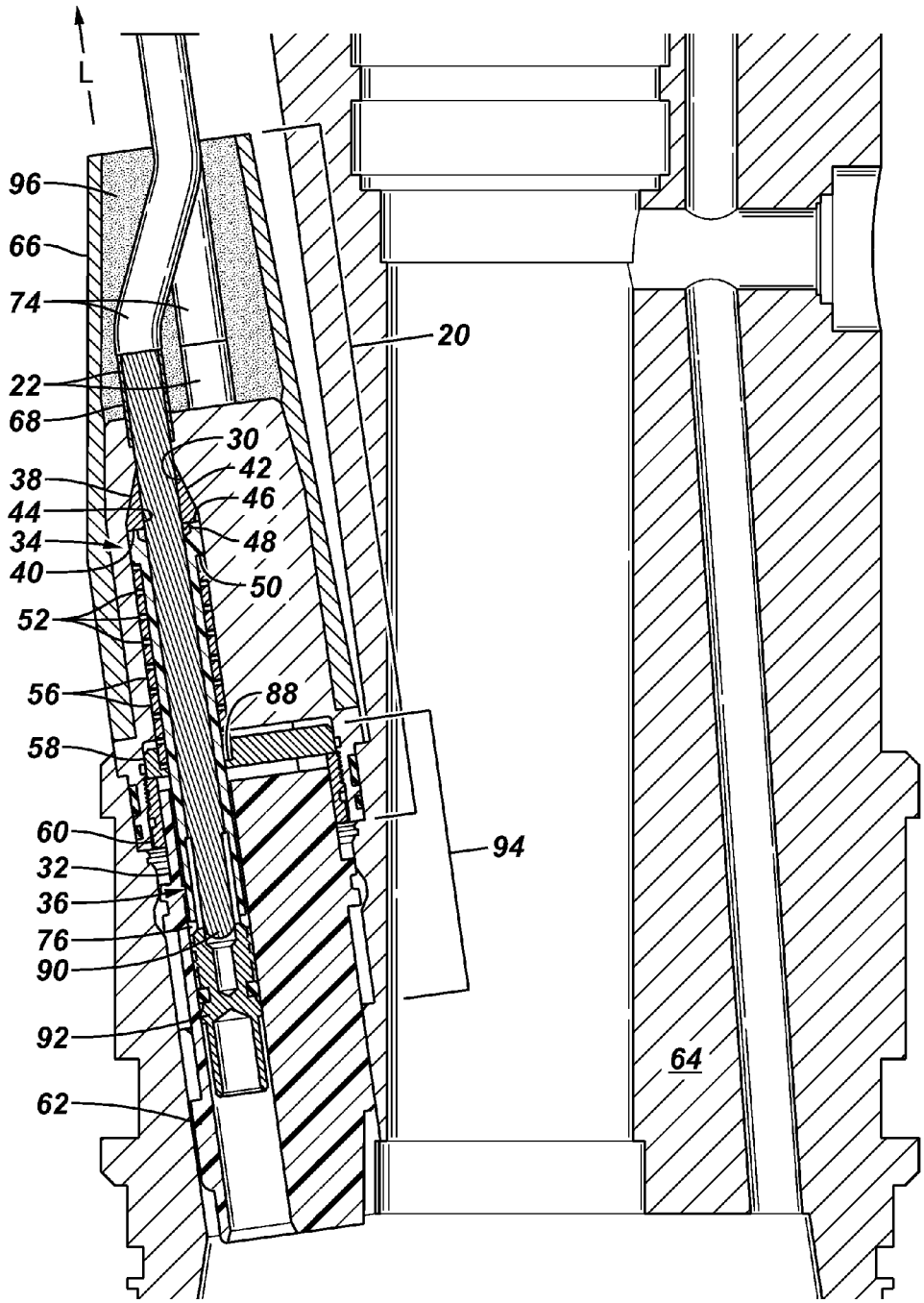
FIG. 2 depicts a preferred embodiment of the pothead connector of FIG. 1 connected to the terminal block of the submersible motor head.

Referring now to FIG. 2, the connection of the pothead connector 20 to a terminal block 62 of the submersible motor head 64 will now be described. The second end 36 of the shroud 32 mates with the recess 76 in the terminal block 62. The exposed male terminal 90 of the electrical cable 22 there makes an electrical connection with the female terminal 92 in the terminal block 62 of the submersible motor head 64. To connect the pothead connector 20 to the terminal block 62 of the submersible motor head 64, the pothead connector 20 is plugged into the pothole 94 in accordance with known techniques.

Figure 12:
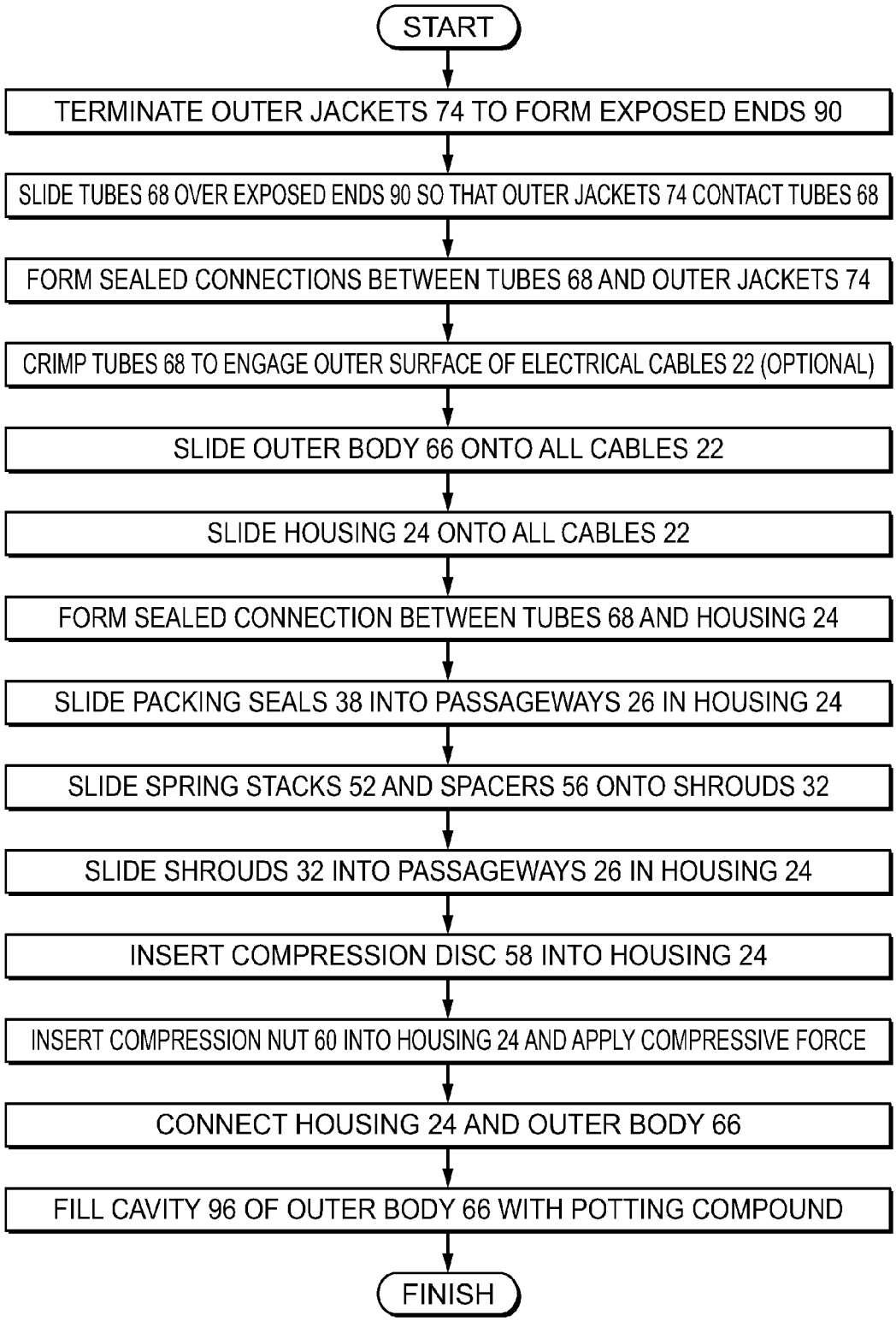
FIG. 12 is a flow chart depicting exemplary method steps for assembling a pothead connector according to preferred embodiments.

Referring now to FIG. 12, one embodiment of a method for assembling the pothead connector 20 is provided. Preparation for one electrical cable 22 being inserted into one passageway 26 is disclosed; however, the same method is used for each of the plurality of electrical cables. To begin, the outer jacket 74 of the electrical cable 22 is terminated to form an exposed end of the electrical cable 22 (also known as the male terminal 90). Next, a tube 68 is slid over the electrical cable 22 and a sealed connection between the tube 68 and the outer jacket 74 is formed. This sealed connection could be formed by crimping the tube 68 into the electrical cable 22 and further by forming a solder seal between the outer jacket 74 and the tube 68. This process is repeated for each of the electrical cables 22 in the plurality. After this, the outer body 66 is slid over all of the electrical cables 22 at once. The housing 24 is next slid over each of the electrical cables 22 such that the electrical cables 22 each fit into a passageway 26. A sealed connection between the tubes 68 and the housing 24 is then formed, preferably by a solder seal. In the embodiment shown, the packing seals 38 are next inserted into the passageways 26 and around each electrical cable 22 until each packing seal 38 abuts the tapered surface 30 in that respective passageway 26. Next, the shrouds 32 are slid over the electrical cables 22, but are not yet slid into the passageways 26. The plurality of spring stacks 52 and spacers 56 are then alternately slid over the shrouds 32 until they contact the outwardly extending shoulder surfaces 50 of the shrouds 32. The shrouds 32, spring stacks 52, and spacers 56 are then slid into the passageways 26. Finally, compression is applied in the longitudinal direction L from the compression nut 60, to the compression disc 58, to the spring stacks 52 and spacers 56 where the closest spring stack contacts the inner shoulder 88 of the compression disk 58. After this, the outer body 66 and the housing 24 are connected by screws (not shown) through screw holes 78 as shown in FIGS. 3 and 4. Finally, the cavity 96 in the outer body 66 is filled with a potting compound in order to redundantly seal any connections made therein.

The above method is only one example of a method for assembling the pothead connector 20. Another embodiment of a method for assembling the pothead connector 20 includes (1) providing a housing 24 that defines a plurality of passageways 26 extending in a longitudinal direction L, each passageway 26 configured to receive one of a plurality of electrical cables 22, wherein each passageway 26 is defined at least partly by a longitudinally extending surface 28 and a tapered surface 30 that extends angularly inwardly relative to the longitudinally extending surface; (2) providing a plurality of shrouds 32 having first ends 34 and second ends 36, wherein the first end 34 of each shroud 32 is disposed in one of the passageways 26, each shroud 32 encircling the electrical cable 22 received in that one passageway 26; (3) providing a plurality of packing seals 38, each packing seal 38 disposed in one of the passageways 26 and encircling the cable 22 received in that one passageway 26, wherein each packing seal 38 is sandwiched between the first end 34 of the shroud 32 and the tapered surface 30 in that passageway 26; and (4) forming a liquid impermeable seal between the shroud 32 and packing seal 38 and a liquid impermeable seal between the packing seal 38 and housing 24 by compressing the shroud 32 against the packing seal 38 in the longitudinal direction L.

The invention claimed is:

1. A pothead connector for connecting a plurality of electrical cables to a terminal block of a submersible motor head, the pothead connector comprising:

a housing defining a plurality of passageways extending in a longitudinal direction, each passageway configured to receive one of the electrical cables; wherein each passageway is defined at least partly by a longitudinally extending surface and a tapered surface that extends angularly inwardly relative to the longitudinally extending surface;

a plurality of shrouds having first and second ends, wherein the first end of each shroud is disposed in one of the passageways, each shroud configured to encircle the electrical cable received in that one passageway; and a plurality of packing seals, each packing seal disposed in one of the passageways and configured to encircle the cable received in that one passageway, wherein each packing seal is sandwiched between the first end of the shroud and the tapered surface in that passageway;

wherein the shroud is biased in the longitudinal direction so as to compress the packing seal outwardly against the tapered surface and inwardly against the electrical cable, to thereby form a liquid impermeable seal between the shroud and packing seal and a liquid impermeable seal between the packing seal and housing.

2. The pothead connector of claim 1, wherein each packing seal in the plurality of packing seals is a conical frustrum having an end surface abutting the first end of the shroud, an outer surface abutting the tapered surface of the passageway, and an inner surface abutting the electrical cable.

3. The pothead connector of claim 2, wherein the first end of each shroud comprises an abutment surface abutting the end surface of the packing seal.

4. The pothead connector of claim 3, comprising an anti-extrusion ring sandwiched between the abutment surface of each shroud and the end surface of each packing seal.

5. The pothead connector of claim 1, wherein the packing seals comprise perfluoroelastomer.

6. The pothead connector of claim 1, wherein the packing seals comprise a hard inner core and a soft outer coating.

7. The pothead connector of claim 1, wherein the shroud comprises an outwardly extending shoulder surface.

8. The pothead connector of claim 7, comprising a plurality of spring stacks, each spring stack disposed in one of the passageways and encircling the shroud in that one passageway, wherein the plurality of shrouds are biased in the longitudinal direction by the plurality of spring stacks.

9. The pothead connector of claim 8, wherein each spring stack in the plurality of spring stacks comprises a plurality of wave springs.

10. The pothead connector of claim 8, wherein each spring stack is separated from another spring stack in the plurality of spring stacks by at least one spacer.

11. The pothead connector of claim 8, comprising a compression disc that is movable by a compression nut, wherein each spring stack in the plurality of spring stacks is compressed between the compression disc and the outwardly extending shoulder surface of the shroud.

12. The pothead connector of claim 1, wherein the shrouds comprise polyimide resin.

13. A method for assembling a pothead connector for connecting a plurality of electrical cables to a terminal block of a submersible motor head, the method comprising:

providing a housing that defines a plurality of passageways extending in a longitudinal direction, each passageway receiving one of the electrical cables; wherein each passageway is defined at least partly by a longitudinally extending surface and a tapered surface that extends angularly inwardly relative to the longitudinally extending surface;

providing a plurality of shrouds having first and second ends, wherein the first end of each shroud is disposed in one of the passageways, each shroud encircling the electrical cable received in that one passageway;

providing a plurality of packing seals, each packing seal disposed in one of the passageways and encircling the cable received in that one passageway, wherein each packing seal is sandwiched between the first end of the shroud and the tapered surface in that passageway; and forming a liquid impermeable seal between the shroud and packing seal and a liquid impermeable seal between the packing seal and housing by compressing the shroud against the packing seal in the longitudinal direction.

14. The method of claim 13, wherein the compressing comprises:

providing a compression nut;

providing a compression disc that is movable by the compression nut;

compressing the compression nut to move the compression disc in the longitudinal direction so that pressure from the compression disc is transferred to the shrouds, thereby compressing the packing seals outwardly against the tapered surfaces and inwardly against the electrical cables and thereby forming liquid impermeable seals between the shrouds and packing seals and liquid impermeable seals between the packing seals and housing.

15. The method of claim 13, further comprising providing a plurality of anti-extrusion rings, one anti-extrusion ring disposed in each of the passageways between the first end of the shroud and the packing seal in that passageway.

16. The method of claim 13, further comprising providing a plurality of spring stacks, one spring stack disposed in each of the passageways and encircling the shroud in that passageway.

17. The method of claim 16, wherein the plurality of spring stacks and the plurality of spacers disposed in each one of the passageways and encircling the shroud in that one passageway, each spring stack separated from another spring stack in the plurality of spring stacks by at least one spacer.

18. The method of claim 16, further comprising:

inserting the electrical cables into the passageways;

sliding the packing seals into the passageways and around the electrical cables until each packing seal abuts the tapered surface in that passageway;

sliding the shrouds over the electrical cables;

sliding the spring stacks and spacers over the shrouds;

inserting the shrouds, spring stacks, and spacers into the passageways; and compressing the shroud in the longitudinal direction with the compression disc and compression nut.

19. The method of claim 13, further comprising:

providing an outer body configured to receive the housing and the plurality of electrical cables;

providing a plurality of tubes configured to receive the plurality of electrical cables and having first and second ends;

connecting the first ends to a plurality of outer jackets on the plurality of electrical cables to form liquid impermeable seals between the tubes and the outer jackets; and connecting the second ends to the housing to form liquid impermeable seals between the tubes and the housing.

20. A pothead connector for connecting a plurality of electrical cables to a terminal block of a submersible motor head, the pothead connector comprising:

a housing defining a plurality of passageways extending in a longitudinal direction, each passageway receiving one of the electrical cables; wherein each passageway is defined at least partly by a longitudinally extending surface and a tapered surface that extends angularly inwardly relative to the longitudinally extending surface;

a plurality of shrouds having first and second ends, wherein the first end of each shroud is disposed in one of the passageways, each shroud encircling the electrical cable received in that one passageway;

a plurality of packing seals, each packing seal disposed in one of the passageways and encircling the cable received in that one passageway, wherein each packing seal is sandwiched between the first end of the shroud and the tapered surface in that passageway; and a plurality of spring stacks and a plurality of spacers, the plurality of spring stacks and the plurality of spacers disposed in one of the passageways and encircling the shroud in that one passageway, each spring stack separated from another spring stack in the plurality of spring stacks by at least one spacer; wherein the shrouds are biased in the longitudinal direction by the plurality of spring stacks and spacers;

wherein each packing seal is a conical frustrum having an end surface abutting the first end of the shroud, an outer surface abutting the tapered surface of the passageway, and an inner surface abutting the electrical cable;

wherein the first end of each shroud comprises an abutment surface abutting the end surface of the packing seal;

wherein each shroud comprises an outwardly extending shoulder surface;

wherein the second end of each shroud mates with a recess in the terminal block of the submersible motor head; and wherein the shroud is biased in the longitudinal direction to compress the packing seal outwardly against the tapered surface and inwardly against the electrical cable, thereby forming a liquid impermeable seal between the shroud and packing seal and a liquid impermeable seal between the packing seal and housing.

* * * * *